United States Patent [19]

Youngblood

[11] 4,202,419

[45] May 13, 1980

[54] ROLLER CUTTER WITH MAJOR AND MINOR INSERT ROWS

[75] Inventor: Thomas F. Youngblood, DeSoto, Tex.

[73] Assignee: Dresser Industries, Inc., Dallas, Tex.

[21] Appl. No.: 2,646

[22] Filed: Jan. 11, 1979

[51] Int. Cl.[2] ..... E21B 9/35

[52] U.S. Cl. ..... 175/374; 175/376; 175/410

[58] Field of Search ..... 175/329, 341, 374–378, 175/409, 410, 331

[56] References Cited

U.S. PATENT DOCUMENTS

| | | | |
|---|---|---|---|
| 3,126,067 | 3/1964 | Schumacher, Jr. | 175/374 |
| 3,306,669 | 2/1967 | Christensen et al. | 175/329 X |
| 3,398,989 | 8/1968 | Christensen | 175/329 X |
| 3,726,350 | 4/1973 | Pessier | 175/374 |
| 3,858,670 | 1/1975 | Ott et al. | 175/374 |
| 3,952,815 | 4/1976 | Dysart | 175/374 |

*Primary Examiner*—Ernest R. Purser
*Assistant Examiner*—Nick A. Nichols, Jr.
*Attorney, Agent, or Firm*—Daniel Rubin; Eddie E. Scott

[57] ABSTRACT

An earth boring system is provided with universal cutter means for boring in all types of formations. The cutter means is mounted on a drill bit body or cutterhead with said bit or cutterhead functioning to form a hole in the earth formations. At least two annular rows of major inserts are mounted in the cutter means. The major inserts project from the surface of the cutter means a substantial distance for forming circular kerfs in the earth formations being bored. An annular row of minor inserts are mounted in the cutter means between the two annular rows of major inserts. The minor inserts project from the surface of the cutter means a distance that is substantially less than the distance the major inserts project from the surface of the cutter means.

6 Claims, 5 Drawing Figures

ROLLER CUTTER WITH MAJOR AND MINOR INSERT ROWS

BACKGROUND OF THE INVENTION

The present invention relates to the art of earth boring and, more particularly, to rolling insert cutter earth boring bits or cutterheads.

Rolling insert cutter earth boring bits and cutterheads provide an efficient way of boring holes through earth formations. Individual hard metal cutting insert elements are positioned in sockets in a rolling cutter body. The rolling cutter body is mounted to rotate on a bit body or cutterhead. The bit body or cutterhead is forced against the formations and rotated causing the cutter to roll over the face of the formations and the inserts to contact the formations to form the desired earth borehole.

Earth boring operations are conducted in various types of formations. These formations range from soft rock formations to hard rock formations. Prior to the present invention different types of cutters were used for boring in the different formations. For example, earth boring cutters having annular rows of projecting inserts separated by spaces were used for boring in soft rock formations. This allowed for the fast removal of the earth formations. In drilling in hard rock formations, earth boring cutters were utilized with the inserts positioned so that the entire face of the formation being drilled was contacted by the hard metal cutting inserts.

DESCRIPTION OF PRIOR ART

In U.S. Pat. No. 3,858,670 to Eugene Gray Ott and William Michael Conn, patented Jan. 7, 1975, an insert cutter for cutting kerfs is shown. The insert cutter is for an earth boring machine that functions to form a plurality of circular kerfs in the earth formations being bored thereby fracturing the portion of the formations between a proximate pair of kerfs and causing fragments of the formations to be separated from the formations being bored. A multiplicity of annular rows of tungsten carbide inserts are positioned in the cutter body thereby simulating the formations loading of a disk cutter. Each insert has an elongated formation contacting head and all of the heads of the inserts in an annular row are aligned. Each annular row of inserts functions to form a circular kerf in the earth formation being bored as the cutter is moved along the formation.

In U.S. Pat. No. 3,726,350 to Rudolf Carl Otto Peisser, patented Apr. 10, 1973, an anti-tracking earth boring drill is shown. In an earth boring drill, a cutter is disclosed with cutting teeth arranged to engage a selected annular area of the borehole bottom in a non-tracking and cutter shell erosion preventing manner during bit rotation. The spacing of the teeth in different circumferential rows of the cutter is changed to maintain an optimum distance between the teeth. Further the teeth are arranged in groups of interrupted spacing and interruption teeth are used selectively to arrange the pattern of teeth to prevent tracking and cutter shell erosion.

In U.S. Pat. No. 3,952,815 to T. R. Dysart, patented Apr. 27, 1976, a system for land erosion protection on a rock cutter is shown. Cone shell erosion between inserts is substantially reduced by positioning small, flat-topped compacts in the vulnerable cutter shell areas. At least one row of substantially outwardly projecting formation contacting inserts are located on the rock cutter. A row of substantially flush compacts are embedded in the cutter shell alternately positioned between the outwardly projecting formation contacting inserts.

SUMMARY OF THE INVENTION

Prior art rolling insert cutter earth boring bits or cutterheads required different types of cutters for formations with different hardness ranges. The cutters designed for harder formations had denser insert row spacing than those for softer formations. When the harder formation cutters were used in soft formations, they drilled too slowly. On the other hand, cutters designed for softer formations had wider spacing which worked well in the soft formations, but in harder rock, ridges formed between the kerfs and many times caused cutter failure. The present invention provides an earth boring rolling insert cutter system that will effectively drill all formation types. This should allow the inventory of cutters to be reduced since a single cutter type can be used for most formations. When boring long holes through formations of different hardnesses, it will be unnecessary to change cutters as the formations change. This will reduce the cost of the finished hole by eliminating the need to retrieve the bit or cutterhead for changing cutters. The hardest formations will be acted upon more advantageously than with conventional cutters. The afore-mentioned features and advantages of the present invention and other features and advantages of the present invention will become apparent from a consideration of the following detailed description of the invention when taken in conjunction with the accompanying drawings.

DETAILED DESCRIPTION OF THE INVENTION

Figure 1:
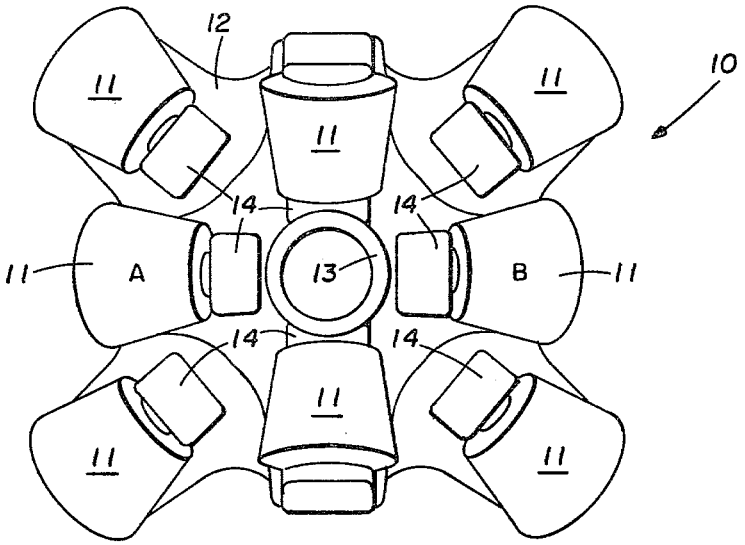
FIG. 1 is an illustration of an earth boring bit incorporating the present invention.

Referring now to the drawings and, in particular, to FIG. 1, an earth boring bit is illustrated and generally designated by the reference number 10. The type of bit illustrated is commonly called a "raise bit" because of its extensive use in boring raise holes between levels of an underground mine. The present invention may be incorporated in earth boring bits for boring raise holes, in other types of earth boring bits and in cutterheads and other equipment for operations wherein an earth borehole is desired. This may include drilling, tunneling and/or boring at any angle to the horizontal either up or down and with or without a pilot hole.

As shown in FIG. 1, a multiplicity of rolling or rotatable cutters 11 are rotatably mounted on a main bit body 12. The rolling cutters 11 are located and spaced so that upon rotation of the bit 10 the formations being drilled will be acted upon by one or more of the cutters 11 to disintegrate the formations. The cutters 11 are held in position by saddles 14 which are mounted on the bit body 12. The saddles 14 allow the cutters 11 to be easily removed and new cutters inserted. An example of a removable cutter and saddle system is shown in U.S. Pat. No. 3,203,492 to C. L. Lichte, patented Aug. 31, 1965. A central drive stem 13 projects from the bit body 12. In operation, the central shaft 13 extends through a pilot hole having a diameter slightly larger than the diameter of shaft 13. The bit 10 is rotated by means of a system well known in the art. As bit 10 rotates the cutters 11 contact and disintegrate the formation as the bit 10 is moved along the pilot hole.

The two cutters designated A and B positioned next to the central drive shaft 13 will be utilized to explain the present invention. It is to be understood that the present invention can be applied to other cutter arrangements. The cutters A and B are termed "paired cutters " and cooperate to perform the desired cutting action on the earth formations. The two cutters A and B are used to provide a balanced drilling bit and a smooth drilling operation. The paired cutters include rows of inserts positioned in a cutter body in a manner that will be explained subsequently with reference to FIG. 2.

Figure 2:
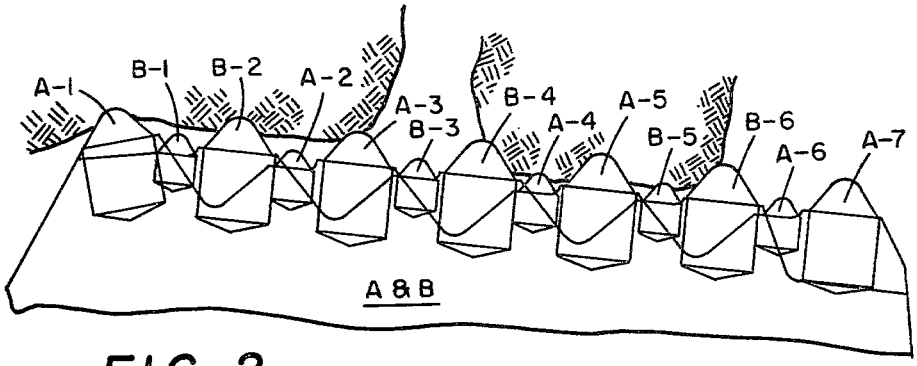
FIG. 2 is a composite illustration of the cutting structure of cutters A and B of the bit shown in FIG. 1 illustrating insert placement.

Referring now to FIG. 2, a composite of the cutting structures of cutters A and B is illustrated. A multiplicity of tungsten carbide inserts are arranged in the cutters to form a series of annular rows. The individual inserts are mounted in and project from cutter shells A and B. The cutter shells are rotatably mounted in the saddles 14 as shown in FIG. 1. The annular rows of inserts act upon the formations to form the desired hole by continually cutting the earth formations being bored, thereby causing fragments of the formations to be separated from the formations being bored. The insert rows A-1 through A-7 are mounted in cutter A and the insert rows B-1 through B-6 are mounted in cutter B. As the bit 10 is rotated, the insert rows A-1 through A-7 and B-1 through B-6 contact the formation to form the pattern on the formations shown in FIG. 2. The penetration of the inserts into the formations is accomplished by repeated rotations of the bit 10.

Although formation hardness types may be described in other terms and the present invention is applicable to other hardness ranges. The cutter system shown in FIG. 2 will be described by way of a specific example to illustrate the present invention. The specific example is in no way intended to be a limitation of the invention. The cutters A and B are illustrated contacting formations ranging from "soft rock" to "hard rock". The "soft rock" formations can be classified as ranging from 0 p.s.i. rock to 25,000 p.s.i. rock, whereas the "hard rock" formations can be classified as ranging from 25,000 p.s.i. rock to 40,000 p.s.i. rock. The major rows of inserts are rows A-1, B-2, A-3, B-4, A-5, B-6 and A-7. The major rows contain $\frac{3}{4}$-inch diameter inserts that have a projection or extension from the cutter body of $\frac{3}{8}$-inch. The minor rows of inserts are rows B-1, A-2, B-3, A-4, B-5 and A-6. The minor rows contain 7/16-inch diameter inserts that have a projection or extension from the cutter body of 7/32-inch. It should be noted, however, that the minor row inserts are positioned in a 3/32-inch recess. This produces a difference in extension between the major rows and minor rows of $\frac{1}{4}$-inch. The difference in extension between the major rows and minor rows is directly related to the difference in penetration in the hard and soft formations that the cutters are expected to encounter. The distance between major rows is $1\frac{1}{2}$ inches and can generally be within the range of $\frac{3}{4}$-inch to $3\frac{1}{2}$ inches.

When drilling in soft formations, the formations break or spall between major rows A-1 and B-2 and A-3 and B-4, B-4 and A-5, A-5 and B-6, B-6 and A-7, with the minor rows (B-1, A-2, B-3, A-4, B-5, A-6) not contacting the face at all. In harder rock, ridges are left between the kerfs cut by the above major rows. When the major rows have cut to the depth which is the difference of relative extension between rows A-1, B-2, A-3, B-4, A-5, B-6, A-7 (major rows) and rows B-1, A-2, B-3, A-4, B-5 and A-6 (minor rows), the minor rows impinge upon the ridges and break that portion of the face away as drilling progresses. The ridges break away relatively easily because of the free face along the sides of the ridges which are generated by the major rows. These free faces are ahead of the minor rows which accounts for their ease of drilliability.

Figure 3:
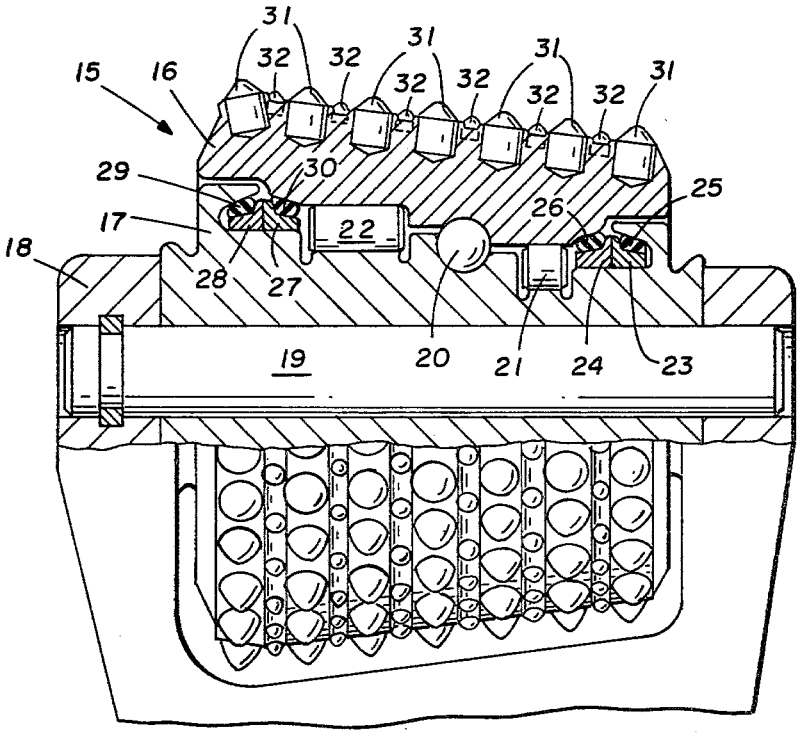
FIG. 3 is an illustrative view of an insert cutter constructed in accordance with a second embodiment of the present invention.

Referring now to FIG. 3, the structural details of another embodiment of a cutter system for an earth boring bit or cutterhead constructed in accordance with the present invention is illustrated. A cutter, generally designated by the reference number 15, includes a multiplicity of carbide inserts arranged to form a series of annular rows. The individual inserts are mounted in a cutter shell 16. The cutter shell 16 is positioned around a bearing shell 17 and the bearing shell 17 is securely locked in a saddle 18. The saddle 18 may be connected to the rotary head of an earth boring machine or to the body of an earth boring bit.

The bearing shell 17 is locked in position in the saddle 18 by a main pin 19. The main pin may be locked in place by a retainer nail or roll pin. The bearing shell 17 remains firmly locked in place throughout the drilling operation due to a tenon and groove arrangement disclosed in U.S. Pat. No. 3,203,492 to C. L. Lichte patented Aug. 31, 1965. A multiplicity of bearing systems including a series of ball bearings 20, a series of inner roller bearings 21 and a series of outer roller bearings 22 promote rotation of the cutter shell 16 about the bearing shell 17. Lubricant is retained in the bearing area by two sets of seal elements. The inner set of seal elements includes a pair of annular metal seal rings 23 and 24 that are positioned near the inner end of the cutter 15. A flexible rubber O-ring 25 is positioned between seal ring 23 and the bearing shell 16 to retain the seal ring 23 in the desired position and resiliently urge seal ring 23 against seal ring 24. A flexible rubber O-ring 26 is positioned between the cutter shell 16 and the seal ring 24 to retain the seal ring 24 in the desired position and resiliently urge the seal ring 24 against seal ring 23. The outer set of seal elements includes a pair of annular metal seal rings 27 and 28 that are positioned near the outer end of the cutter 15. A flexible rubber O-ring 29 is positioned between the seal ring 28 and bearing shell 16 to retain the seal ring in the desired position and resiliently urge seal ring 28 against seal ring 27. A flexible rubber O-ring 30 is positioned between the cutter shell 16 and seal ring 27 to retain seal ring 27 in the desired position and resiliently urge seal ring 27 against seal ring 28.

The present invention provides an earth boring cutter that will drill all formation types. In the past, different type cutters were required for formations with different hardness ranges. The cutters designed for the harder formations had a denser row spacing than those for softer formations. Therefore, if used in soft formations, they drilled too slow, and often in hard formations, there was insufficient load per cutting edge to properly fracture the rock. On the other hand, cutters designed for softer formations had wider spacing which worked well in the soft formations, but in harder rock, ridges formed between the kerfs and many times caused cutter failure. The cutter 15 will drill efficiently in soft formations and in hard formations. The ridges formed between kerfs will actually cause the hard formations to be more easily broken away in that area.

A multiplicity of major annular rows 31 of inserts extend a substantial distance from the cutter shell. A multiplicity of minor annular rows 32 of inserts project a lesser distance from the cutter shell 16. While drilling soft formations, the formations break or spall between major rows 31. In harder rock there are ridges left between the kerfs cut by the major rows. When these rows 31 have cut to the depth which is the difference of relative extension between rows 31, the minor rows 32 will impinge upon the above-mentioned ridges and break that portion of the face away as drilling progresses. The ridges break away relatively easily because of the free face along the sides of the ridges which are generated by the major rows 31. These free faces are ahead of the minor rows 32 which accounts for their ease of drillability.

The structural details of a second embodiment of a cutter 15 constructed in accordance with the present invention having been described, the operation of the cutter 15 will now be considered. The saddle 18 is connected to a rotary drilling head or bit and the head or bit is rotated and moved through the formations. In soft formations, the inserts in the major rows contact the formations and form a plurality of circular kerfs therein. The portions of the formations between adjacent kerfs tend to fracture out and the fragments are separated from the formations being bored to form the desired hole or tunnel. The heads of the inserts in each major annular row 31 simulate a continuous line contact with the formations. The continuous line contact serves to form individual kerfs in the formations being bored. The cutter 15 will therefore disintegrate a complete swath of formation with a single rotation of the rotary head or bit thereby eliminating the need for a trailing or paired cutter. In harder rock, ridges are left between the kerfs cut by the major rows 31. When the rows 31 have cut to the depth which is the difference of relative extension between the major and minor rows, the minor rows impinge upon the ridges and break that portion of the face away as drilling progresses.

Figure 4:
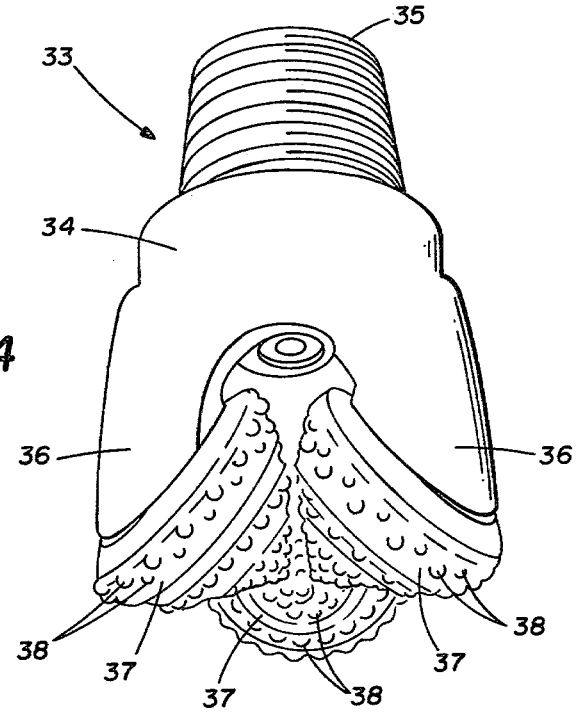
FIG. 4 is an illustration of an earth boring bit constructed in accordance with another embodiment of the present invention.

Referring now to FIG. 4, an earth boring bit generally designated by the reference number 33 is shown. The bit 33 is commonly called a three cone rotary rock bit. The bit 33 includes a main bit body 34 supporting three rotatable conical cutter members 37. Each of the cutter members 37 is arranged so that its axis of rotation is oriented generally toward the center line of the bit which coincides with the longitudinal axis of the borehole. A central passageway extends downwardly into the bit body 34. The bit body 34 also includes an external threaded pin portion 35 for allowing the bit 33 to be connected to the lower end of a string of hollow drill pipe. The depending arms 36 are provided with a journal portion or bearing for rotatably supporting cutter members 37. Each of the three arms 36 of the bit terminates in a shirttail that is disposed in close proximity to the wall of the hole being drilled. A multiplicity of tungsten carbide inserts 38 are embedded in the outer surface of the cone cutters for disintegrating the formations as the bit 33 is rotated and moved downward.

Figure 5:
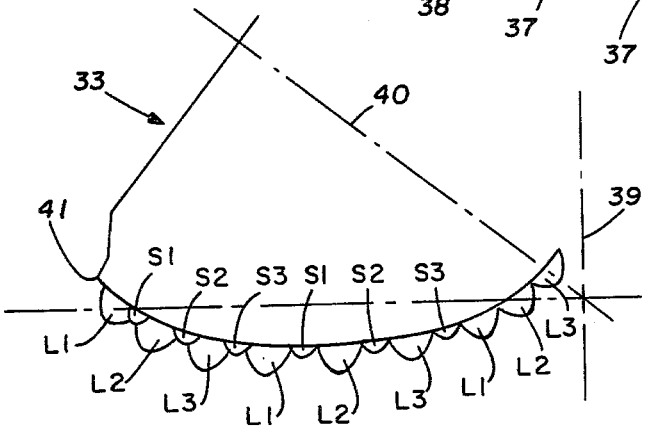
FIG. 5 is a composite illustration of the cutting structure of the three cutters of the bit shown in FIG. 4 illustrating insert placement.

Referring now to FIG. 5, a standard cluster layout for the three cone rotary rock bit 33 is illustrated. As previously stated, the bit 33 includes three rotatable cone cutters. The cone cutters have intermeshing major annular rows of inserts. For example, the first cone cutter includes major annular rows of long inserts L1. These major rows generally intermesh with major rows of long inserts L2 and L3 on the second and third cone cutters respectively. In the same manner, the second and third cone cutter major rows of long inserts L2 and L3 intermesh with the major rows of long inserts on the respective adjacent cone cutters. The rotary rock bit also includes minor rows of short inserts. For example, the first cone cutter includes minor rows of short inserts S1, the second cone cutter includes minor rows of short inserts S2 and the third cone cutter includes minor rows of short inserts S3. A composite of the three cone cutters of the bit 33 is illustrated in FIG. 5. The bit 33 rotates about the axis 39. The axes of the three cone cutters are represented by line 40.

The rotary rock bit 33 will drill all formation types. In the past, different bit types were required for formations with different hardness ranges. The bits designed for the harder formations had a denser row spacing than those for softer formations. Therefore, if used in soft formations, they drilled too slowly. On the other hand, bits designed for softer formations had wider spacing which worked well in the soft formations, but in harder rock, ridges formed between the kerfs and many times caused cutter failure. The bit 33 will drill efficiently in soft formations and in hard formations. The ridges formed between kerfs will actually cause the hard formations to be more easily broken away in that area.

The multiplicity of major annular rows of long inserts L1,L2 and L3 extend a substantial distance from the cutter shells. The multiplicity of minor annular rows of short inserts S1, S2 and S3 project a lesser distance from the cutter shells. While drilling soft formations, the formations break or spall between major rows L1, L2 and L3. In harder rock there are ridges left between the kerfs cut by the major rows. When these rows have cut to the depth which is the difference of relative extension between the major rows, the minor rows, S1, S2 and S3 will impinge upon the above-mentioned ridges and break that portion of the face away as drilling progresses. The ridges break away relatively easily because of the free face along the sides of the ridges which are generated by the major rows L1, L2 and L3. These free faces are ahead of the minor rows S1, S2 and S3 which accounts for their ease of drillability.

The structural details of another embodiment of an earth boring bit constructed in accordance with the present invention having been described, the operation of the bit 33 will now be considered. The bit 33 is connected to a rotary drill string and the bit is rotated and moved through the formations. In soft formations, the long inserts L1, L2 and L3 contact the formations and form a plurality of circular kerfs therein. The portions of the formations between adjacent kerfs tend to fracture out and the fragments are separated from the formations being bored to form the desired borehole. The inserts in each major annular row L1, L2 and L3 simulate a continuous line contact with the formations. The continuous line contact serves to form individual kerfs in the formations being bored. In harder rock, ridges are left between the kerfs cut by the major rows L1, L2 and L3. When the major rows have cut to the depth which is the difference of relative extension between the major and minor rows, the minor rows S1, S2 and S3 impinge upon the ridges and break that portion of the face away as drilling progresses.

The embodiments of the invention in which an exclusive property or privilege is claimed are defined as follows:

1. A multiformation earth boring apparatus, comprising:

a bit body;

a rolling cutter member rotatably mounted on said bit body, said rolling cutter member having a surface;

a multiplicity of individual major inserts;

a corresponding multiplicity of sockets for receiving said major inserts;

a multiplicity of major annular rows extending around said rolling cutter member, said major annular rows comprising said major inserts mounted in said rolling cutter member and projecting from said surface a substantial distance;

a multiplicity of individual minor inserts;

a corresponding multiplicity of sockets for receiving said minor inserts; and a minor annular row extending around said rolling cutter member, said minor annular row comprising said minor inserts mounted in said rolling cutter member and projecting from said surface a lesser distance than said substantial distance that said major inserts project from said surface, said minor annular row of minor inserts located between said major annular rows of major inserts.

2. The earth boring apparatus of claim 1 including a second rolling cutter member providing a set of paired rolling cutters.

3. The earth boring apparatus of claim 1 including three rolling cutter members comprising three rolling cone cutters.

4. A universal earth boring apparatus for boring through earth formations, said earth boring apparatus forming kerfs in the earth formations, comprising:

a bit body;

a rolling cutter member rotatably mounted on said bit body for disintegrating said earth formations, said rolling cutter member having an external surface;

a multiplicity of individual major inserts;

a corresponding multiplicity of sockets for receiving said major inserts;

at least two annular major rows extending around said rolling cutter member, said major annular rows comprising major inserts mounted in said rolling cutter member and projecting from said surface a distance sufficient to form kerfs in said earth formations;

a multiplicity of individual minor inserts;

a corresponding multiplicity of sockets for receiving said minor inserts; and a minor annular row extending around said rolling cutter member, said minor annular row comprising said minor inserts mounted in said rolling cutter member and projecting from said surface a lesser distance than said substantial distance that said major inserts project from said surface a substantially lesser distance from said surface than said major inserts project from said surface, said minor annular row of minor inserts located between said at least two annular major rows of major inserts.

5. The earth boring apparatus of claim 4 including a second rolling cutter member providing a set of paired rolling cutters.

6. The earth boring apparatus of claim 4 including three rolling cutter members comprising three rolling cone cutters.

* * * * *